US008305277B2

(12) United States Patent
Reams

(10) Patent No.: US 8,305,277 B2
(45) Date of Patent: Nov. 6, 2012

(54) APPARATUS AND METHODS FOR SNOW AND ICE DETECTION AND REMOVAL ON A COMMUNICATION ANTENNA

(75) Inventor: William Reams, Englewood, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 433 days.

(21) Appl. No.: 12/776,152

(22) Filed: May 7, 2010

(65) Prior Publication Data

US 2011/0273344 A1 Nov. 10, 2011

(51) Int. Cl.
*H01Q 19/12* (2006.01)

(52) U.S. Cl. ..... 343/704; 343/840

(58) Field of Classification Search ..... 343/704, 343/840

See application file for complete search history.

(56) References Cited

U.S. PATENT DOCUMENTS

| | | | | |
|---|---|---|---|---|
| 4,808,824 | A | 2/1989 | Sinnar | |
| 5,243,185 | A | 9/1993 | Blackwood | |
| 5,296,853 | A | 3/1994 | Federow et al. | |
| 5,617,107 | A * | 4/1997 | Fleming | 343/704 |
| 5,861,855 | A | 1/1999 | Arsenault et al. | |
| 6,084,550 | A * | 7/2000 | Jones | 343/704 |
| 6,137,446 | A * | 10/2000 | Jones | 343/704 |
| 6,172,647 | B1 * | 1/2001 | Jones | 343/704 |
| 6,326,930 | B1 * | 12/2001 | Jones | 343/704 |
| 7,348,586 | B2 | 3/2008 | Ishikawa et al. | |
| 7,370,525 | B1 | 5/2008 | Zhao et al. | |
| 2005/0263646 | A1 | 12/2005 | Nichols | |

OTHER PUBLICATIONS

Stephens, Mark Benedict, U.S. Appl. No. 12/492,038, filed Jun. 25, 2009, 20 pages.

* cited by examiner

*Primary Examiner* — Hoanganh Le
(74) *Attorney, Agent, or Firm* — Lowe Graham Jones PLLC

(57) ABSTRACT

A method of detecting and removing ice and/or snow on a communication antenna is presented. In the method, environmental data indicating at least one current environmental condition is received. An optical signal is transmitted from a signaling structure of the communication antenna toward a reflecting surface of the antenna. The optical signal is received at the signaling structure upon returning from the reflecting surface. The returning optical signal is then processed to determine at least one characteristic value of the returning optical signal. The reflecting surface is then heated if the environmental data indicates that ice or snow accumulation on the communication antenna is possible, and the at least one characteristic value of the returning optical signal is outside a predetermined range.

22 Claims, 6 Drawing Sheets

APPARATUS AND METHODS FOR SNOW AND ICE DETECTION AND REMOVAL ON A COMMUNICATION ANTENNA

BACKGROUND

Communication antennas employed for reception and/or transmission of communication signals are typically located in an outdoor environment, and are thus often susceptible to a variety of weather conditions that may inhibit the reception and/or transmission of the communication signals. For example, the effectiveness of antennas employing a parabolic signal-reflecting surface, such as those utilized in satellite communication systems, may be temporarily reduced by the presence of ice or snow on the reflecting surface. Further, while manual clearing of the ice or snow from the antenna may be possible in some installations, other environments, such as office buildings, apartment buildings, and the like, may require that the antenna be located out-of-reach, or even out-of-sight, thus rendering such manual clearing unlikely. Moreover, in systems in which large antennas are employed, the clearing of ice or snow by manual means, while possible, may be impractical.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

The enclosed drawings and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

Figure 1:
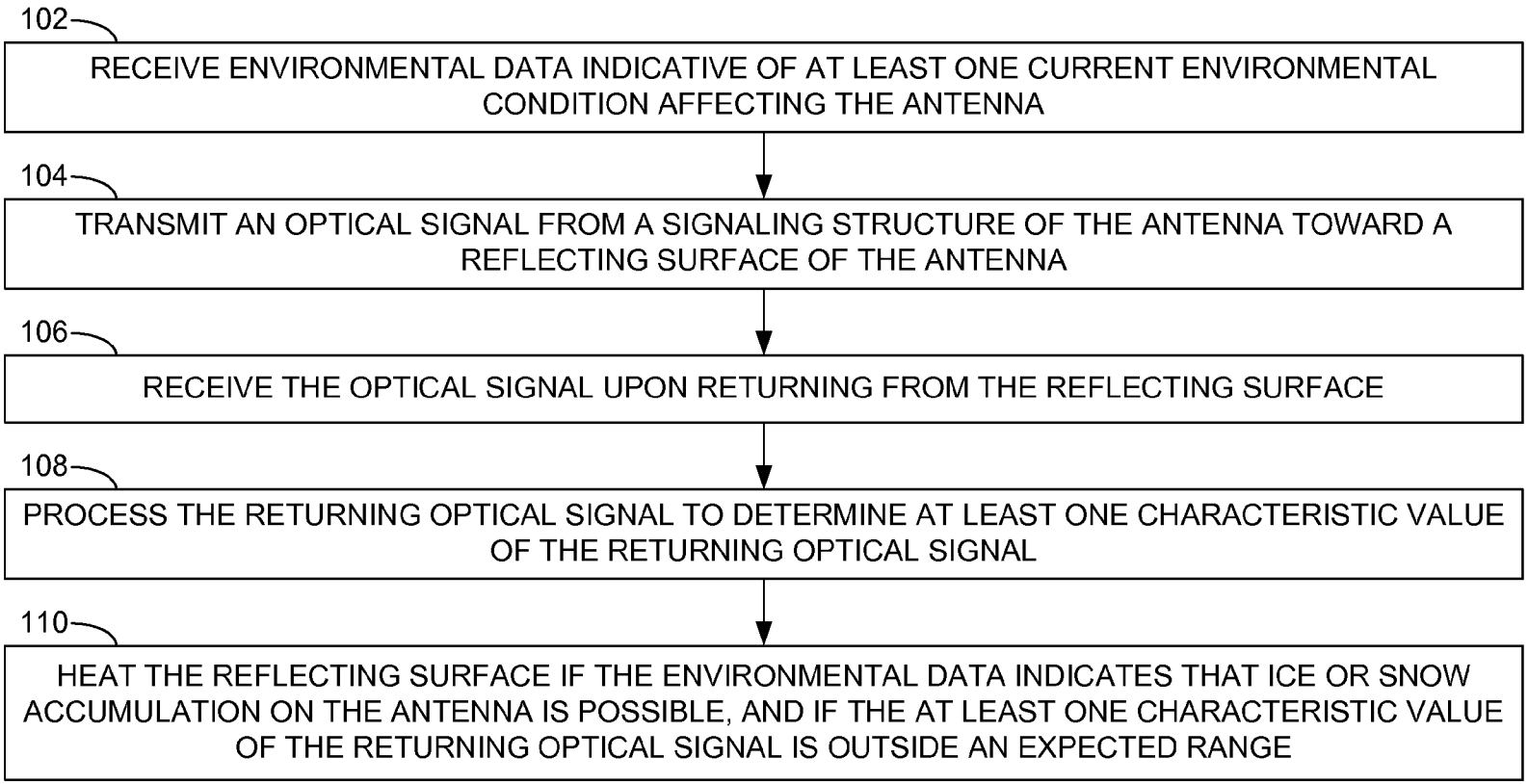
FIG. 1 is a flow diagram of a method according to an embodiment of the invention of detecting and removing snow and/or ice on a communication antenna.

FIG. 1 presents a method 100 of detecting and removing snow and/or ice on a communication antenna. At least some of the operations described in the method 100 may be performed via circuitry of the antenna, circuitry of an electronic device performing communications via the antenna, or by other electronic means. In the method 100, environmental data indicative of at least one current environmental condition affecting the antenna is received (operation 102). An optical signal is transmitted from a signaling structure of the antenna toward a reflecting surface of the antenna (operation 104). The optical signal is received at the signaling structure upon returning from the reflecting surface (operation 106). The returning optical signal is then processed to determine at least one characteristic value of the returning optical signal (operation 108). The reflecting surface is then heated if the environmental data indicates that ice or snow formation on the antenna is possible, and if the at least one characteristic value of the returning optical signal is outside a predetermined range (operation 110). In other embodiments, a computer-readable storage medium may have encoded thereon instructions for a processor or other control circuitry of the antenna, attached communication device, or the like to implement the method 100.

As a result of employing the method 100, snow and ice may be removed from an antenna by heating at least a portion of the antenna when such accumulation is detected. Detection of the presence of snow or ice is provided by optical detection of the accumulation on the antenna combined with data describing one or more environmental factors necessary for such accumulation, such as low temperature, sufficient humidity, and so on. Data describing the environmental conditions impacting the antenna may be received from some external device, such as a home weather stations, remote weather information website, or the like, thus relieving the antenna and connected communication device of the responsibility of measuring atmospheric conditions necessary for ice or snow accumulation. Additional advantages may be recognized from the various implementations of the invention discussed in greater detail below.

Figure 2:
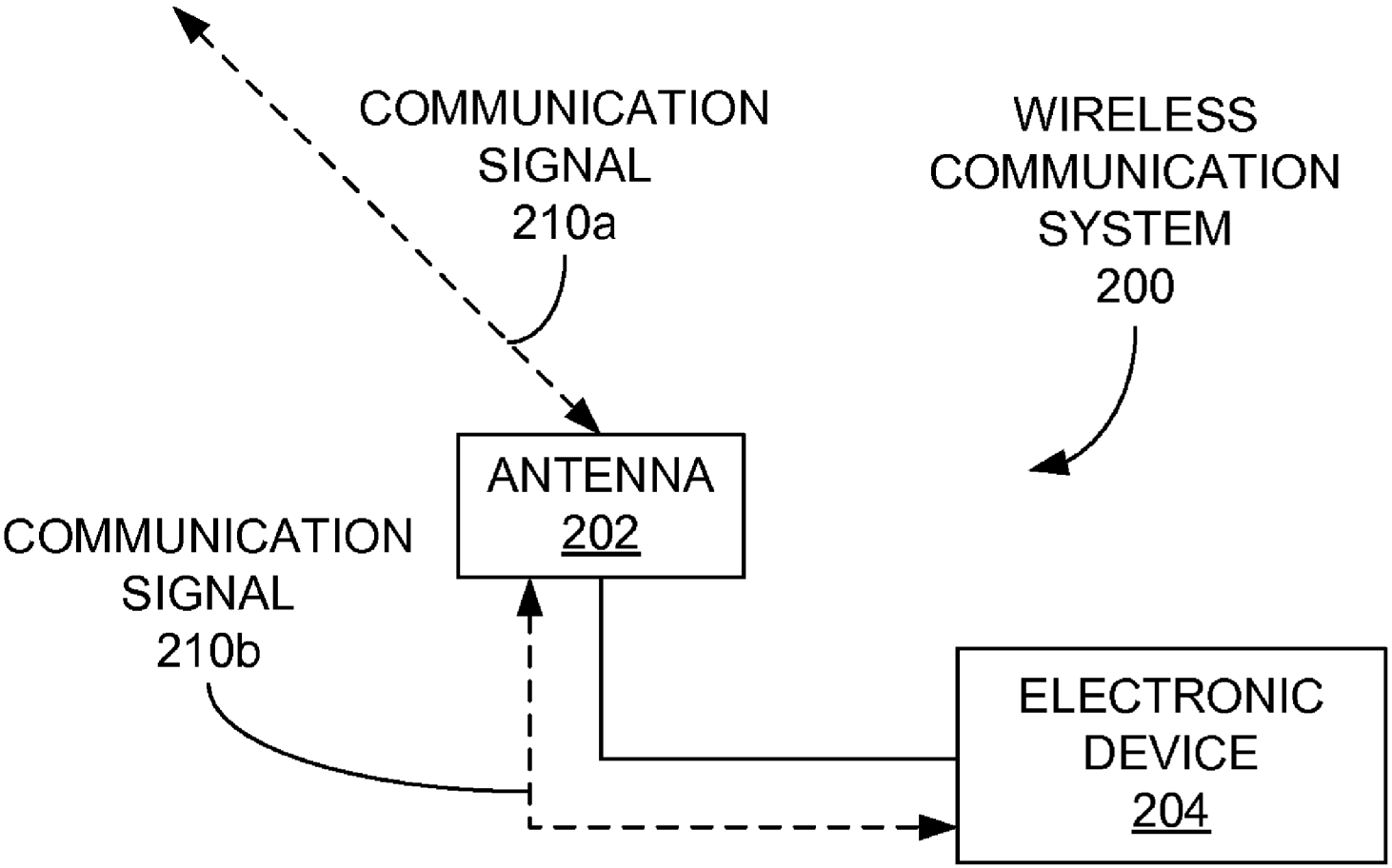
FIG. 2 is a simplified block representation of a wireless communication system according to an embodiment of the invention.

FIG. 2 illustrates a wireless communication system 200 including an electronic device 204 communicatively coupled with an antenna 202. If the electronic device 204 is configured as a communication receiver, the antenna 202 is configured to receive a communication signal 210*a* from a communication signal source, such as a satellite or terrestrial transmission antenna, potentially process the received signal 210*a*, and then transfer the resulting communication signal 210*b* to the electronic device 204. In addition to, or in lieu of, performing as a communication receiver, the electronic device 204 may operate as a communication transmitter or source, transmitting the communication signal 210*b* to the antenna 202, which may process and transmit the resulting communication signal 210*a*.

The electronic device 204 may be a broadcast transmitter or receiver, such as that employed for terrestrial or satellite television and radio signals. In other embodiments, the electronic device 204 may employ any other type of wireless signals received or transmitted via an antenna exposed to outdoor environments.

Similarly, the antenna 202 may be any antenna utilized outdoors for the transmission or reception of wireless communication signals 210*a*. The antenna 202 may also process the received communication signal 210, such as frequency down-conversion or up-conversion, amplification, and filtering prior to forwarding or retransmitting the signal 210 toward its ultimate destination. Additionally, the antenna 202 includes a structure or surface that plays a role in the transmission or reception of the wireless communication signal 210*a*. Moreover, such a structure or surface, such as a parabolic dish, a mesh surface, or the like, may act as a collection area for snow and ice that adversely affects the reception and/or transmission functions of the antenna 202.

Figure 3:
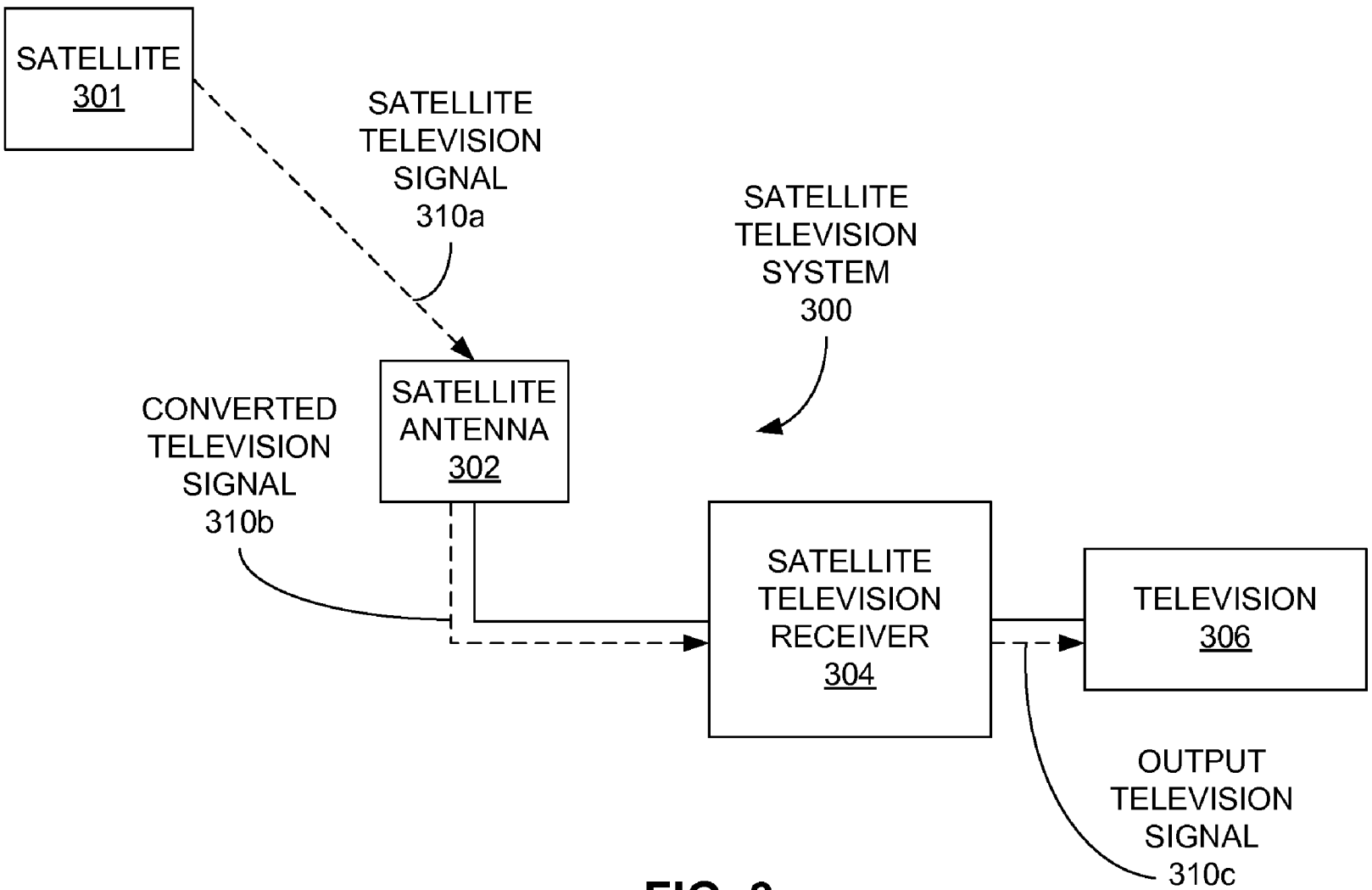
FIG. 3 is a block diagram of a satellite television system according to an embodiment of the invention.

In a more specific embodiment, FIG. 3 illustrates a satellite television system 300 that includes a satellite television receiver 304 connected to a satellite antenna 302. The satellite antenna 302 receives one or more satellite television signals 310*a* carrying television content received from a satellite uplink center by way of one or more transponders resident in a satellite 301 in geosynchronous orbit. The satellite antenna 302 then down-converts the frequencies of the satellite television signal 310*a* and forwards the resulting converted television signal 310*b* to the satellite television receiver 304.

The satellite television receiver 304, often referred to as a satellite television "set-top box", then further processes the converted television signals 310*b*, selects at least one television program or channel under control of a user of the receiver 304, formats the channel or program for output, and then outputs the resulting output television signal 310*c* to at least one television 306 for presentation to the user.

Figure 4:
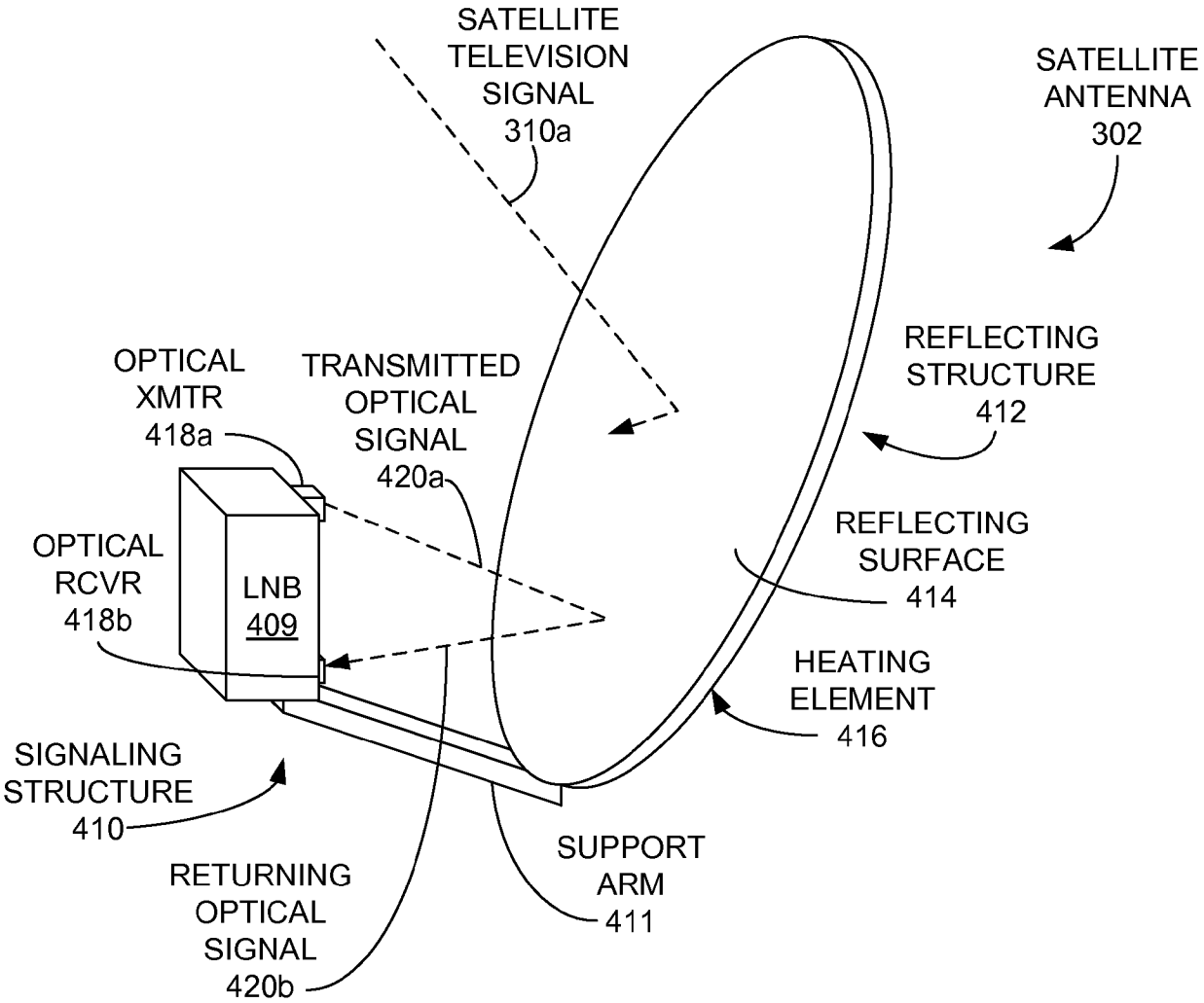
FIG. 4 is a perspective view of an antenna for the satellite television system depicted in FIG. 3 according to an embodiment of the invention.

FIG. 4 presents a perspective view of the satellite antenna 302 of FIG. 3 according to one embodiment. The satellite antenna 302 is configured as a typical parabolic or "dish" antenna 302 having a reflecting structure 412 with a reflecting surface 414 designed to receive the wireless television signal 310*a* and reflect the signal 310*a* to a signaling structure 410. Typically, the signaling structure 410 includes a signal receiving device, such as a low-noise block-converter (LNB) 409 adapted to receive the incoming wireless television signal 310*a*, down-convert the frequencies of the signal 310*a*, and forward the signal to the satellite television receiver 304 by way of coaxial cable (not explicitly shown in FIG. 4) or other means. A support arm 411 connects the LNB 409 with the reflecting structure 412 and correctly positions the LNB 409 to receive the reflected wireless signal 310*a* from the reflecting surface 414. Generally, the antenna 302 must be oriented correctly to receive the wireless television signal 310*a* from one or more desired satellites.

As indicated above, snow or ice buildup on the reflecting surface 414, the support arm 411, or the surface of the LNB 409 may adversely affect the reception of the signal 310*a* at the LNB 409 by absorbing, misdirecting, and/or dispersing at least some portion of the signal 310*a* away from the LNB 409. While the following discussion focuses on accumulation on the reflecting surface 414, accumulation on other antenna structures, such as the support arm 411 and the LNB 409, may also adversely affect signal 310*a* reception. To detect the accumulation of ice and snow, the antenna 302 includes an optical signal transmitter 418*a* for directing an optical signal 420*a* toward the reflecting surface 414, which redirects the optical signal 420*a* as a returning optical signal 420*b* to a corresponding optical signal receiver 418*b*. Typically, the optical transmitter 418*a* is oriented to cause the maximum amount of light of the returning optical signal 420*b* to be received at the optical receiver 418*b*. As described more completely below, the strength, amplitude, magnitude, or other characteristic of the returning optical signal 420*b* as received at the optical receiver 418*b* indicates whether snow or ice has accumulated on the reflecting surface 414. In one implementation, the reflecting surface 414 may possess a particular paint or coating of a color or material that maximizes the difference in signal reflectivity of the reflecting surface 414 compared to the reflectivity of ice or snow.

The optical signal transmitter 418*a* may be configured to emit at least one frequency or band of frequencies to be redirected by the reflecting surface 414. Possible examples of the optical transmitter 418*a* include a light-emitting diode (LEDs) of any visible color, an infrared (IR) LED, an ultraviolet (UV) LED, or any other optical signal source. Similarly, the optical receiver 418*b* may be any device, such as a photodiode or phototransistor, employable to detect and/or measure the optical signal generated by the transmitter 418*a* as received from the reflecting surface 414.

Presuming ice or snow have been detected on the reflecting surface 414, one or more heating elements 416 coupled with the reflecting structure 412 may be employed to heat the reflecting surface 414, thus melting the accumulation of ice and snow therefrom. In one example, the heating element 416 may be one or more resistive electrical conductors that radiate heat when carrying an electrical current. In various embodiments, the heating element 416 may be incorporated within, laid atop, or place behind the reflecting surface 414 of the reflecting structure 412. In other implementations, other forms of heat-generating devices, such as heat-producing lamps, may be utilized to heat the reflecting surface 414. In another example, at least part of the signaling structure 410, such as the support arm 411 and/or the LNB 409, may be heated by the heating element 416 as well. Power for the heating element 416 may be supplied by connecting the heating element 416 to a power supply, by a battery, by power delivered from the receiver 304 via the coaxial cable connecting the LNB 409 to the receiver 304, or via some other means.

Figure 5:
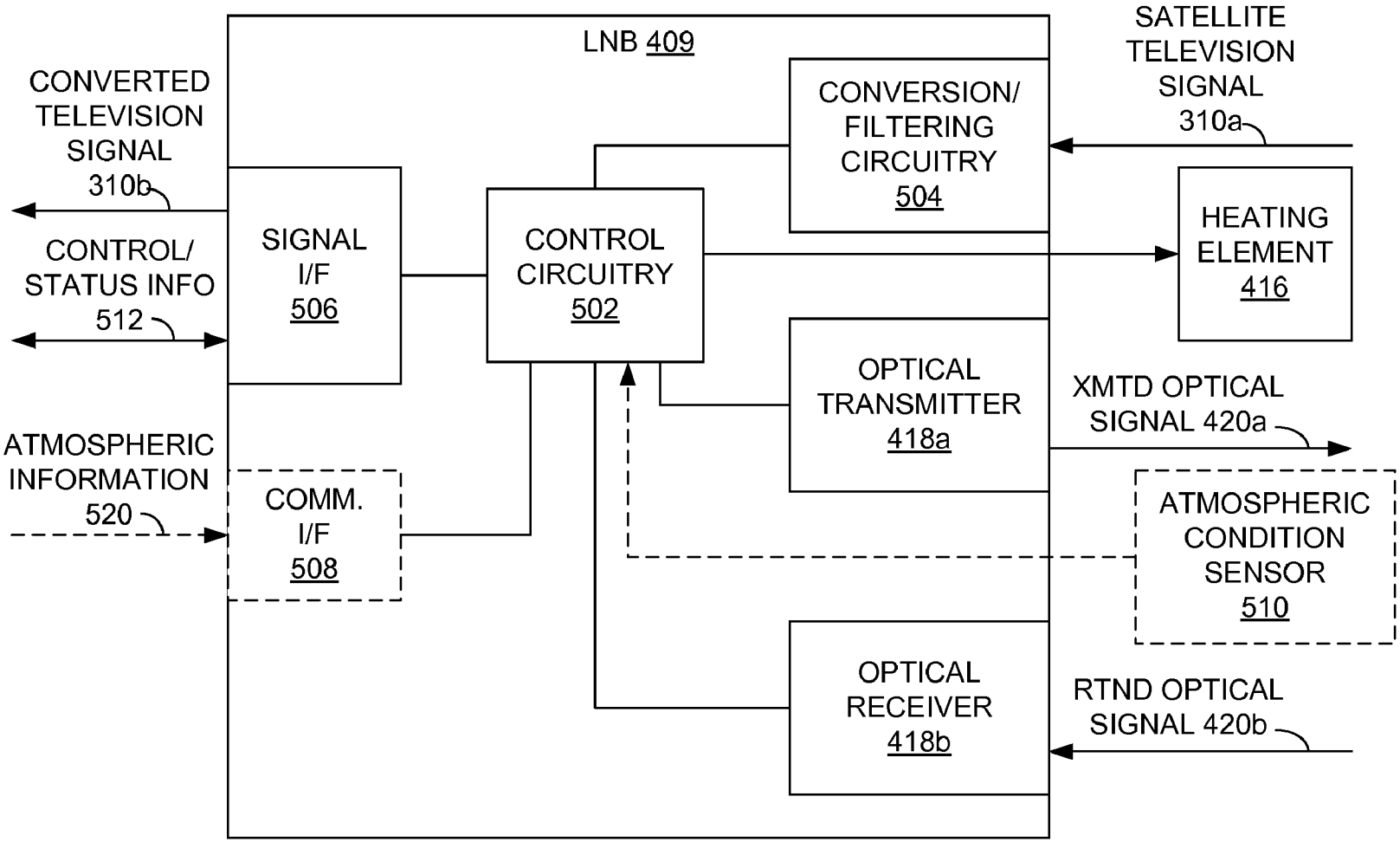
FIG. 5 is a block diagram of a low-noise block-converter (LNB) of the antenna illustrated in FIG. 4 according to an embodiment of the invention.

FIG. 5 provides a block diagram of circuitry associated with the LNB 409 of FIG. 4, including control circuitry 502, signal conversion/filtering circuitry 504, a signal interface 506, and possibly a communication interface 508 and one or more atmospheric condition sensors 510. Also incorporated in the LNB 409 may be the optical signal transmitter 418*a* and receiver 418*b* discussed above, and possibly the heating element 416. Other components, such as a power supply, coupler, or converter, may be included, but are not mentioned hereinafter to simplify the following discussion.

The conversion and filtering circuitry 504 is configured to receive or capture the wireless television signal 310*a* from the reflecting surface 414 and perform any conversion, filtering, and other processing of the received signal 310*a* before forwarding the signal by way of the signal interface 506 as the converted television signal 310*b* to the satellite television receiver 304. In one example, the wireless television signal 310*a* is a radio frequency (RF) signal that is down-converted to an intermediate frequency (IF) and transported over coaxial cable to the receiver 304.

The signal interface 506 may also be configured to send and receive control and status information 512 between the control circuitry 502 and the television receiver 304. In one implementation, the signal interface 506 conforms to the Digital Satellite Equipment Control (DiSEqC) communication protocol for the transmission and reception of the control and status information 512, although other protocols or formats may be employed in other embodiments. As is described in greater detail below, the control and status information 512 may be used to provide information regarding the atmospheric conditions in the geographical area in which the antenna 302 is located, the possible existence of ice accumulation on the reflecting surface 414, the control of the heating element 416, and so on.

In some examples, the control circuitry 502 may be coupled with a communication interface 508 for receiving information regarding atmospheric conditions from other communication devices. One such device may be a home weather station that measures temperature, humidity, barometric pressure, and the like in the vicinity of the antenna 302. Another possible device is a communication node or server of a wide-area network (WAN), such as the Internet, which may provide atmospheric condition data or information to the control circuitry 502 to aid in determining whether the heating element 416 should be activated.

In some cases, the atmospheric condition data may be supplied to the control circuitry 502 via one or more sensors 510 coupled with the signaling structure 410 or the reflecting structure 412. For example, a temperature sensor, such as a thermistor or other temperature-sensitive device, may provide some indication of the current temperature of the reflecting surface 414 or surrounding air. Other types of sensors 510, such as humidity and barometric pressure sensors, may be included in other examples.

As discussed more fully below, the control circuitry 502 is configured to control or communicate with each of the components of the LNB 409 or reflecting structure 412, such as the conversion circuitry 504, the signal interface 506, the communication interface 508, the sensors 510, the optical signal transmitter 418*a* and corresponding receiver 418*b*, and the heating element 416. The functionality of the control circuitry 502 as it more specifically relates to the detection and removal of ice and snow from the reflecting surface 414 is described more completely below. The control circuitry 502 may include one or more processors, such as a microprocessor, microcontroller, or digital signal processor (DSP), configured to execute instructions directing the processor to perform the functions associated with the control circuitry 502. In another implementation, the control circuitry 502 may be completely hardware-based logic, or may include a combination of hardware, firmware, and/or software elements.

In operation, the control circuitry 502 may first determine whether current environmental or atmospheric conditions, such as temperature, humidity, and/or barometric pressure, in the vicinity of the satellite antenna 302 are conducive to snowy or icy conditions. Data representing one or more such conditions may be received by way of the signal interface 506 as control/status information 512 received from the television receiver 304, which in turn receives the information from another device, such as a weather information monitoring device typically deployed at home, or a weather information node accessible over the Internet. Alternatively, one or more of the data items indicating current atmospheric conditions may be retrieved via the sensors 510, which may be located in the LNB 409, the support arm 411, the reflecting structure 412, or another location on, in, or near the antenna 302. One or more of these data items may then be employed to determine whether the reflecting surface 414 of the antenna 302 should be checked for the presence of ice or snow.

In one embodiment, the control circuitry 502 receives an indication of the current temperature at, or in the vicinity of, the antenna 302. For example, the current temperature may have been measured at the antenna 302 itself, a few inches or feet away, at the same home or apartment, or someplace in the same ZIP code or town within which the antenna 302 is located. If the control circuitry 502 determines that the current temperature is less than some predetermined level, such as 0 or 3 degrees Celsius, the control circuitry may then control and employ the optical signal transmitter 418*a* and receiver 418*b* to monitor the reflecting surface 414 to determine if snow or ice is present.

In another implementation, the control circuitry 502 may use two or more data items, such as the current temperature and the current humidity (such as relative or absolute humidity), measured at, or in the vicinity of, the antenna 302. For example, the control circuitry 502 may require that the current temperature be below a first level, while the current humidity is above a second level, before the optical transmitter 418*a* and receiver 418*b* are employed to determine snow or ice accumulation. In another example, the temperature threshold to be compared against the current temperature may depend on the current humidity level, or vice-versa. In this case, a data table associating each of multiple temperature thresholds with a specific humidity level may be utilized so that a current humidity level may be used to identify the temperature threshold to be compared against the current temperature. If the current temperature is below that threshold, the control circuitry 502 may then employ the optical transmitter 418*a* and receiver 418*b* to determine if snow or ice has accumulated on the reflecting surface 414. Other atmospheric data, such as the current barometric pressure, may be combined with either or both of the current temperature and the current humidity in a similar manner to determine if the reflecting surface 414 is to be monitored optically.

The decision to employ the optical transmitter 418*a* and receiver 418*b* may also be based on trends in the atmospheric data, instead of or in addition to the current values of that data. For example, any or all of a falling barometric pressure, a falling temperature, and a rising humidity over time, possibly in conjunction with specific threshold values for barometric pressure, temperature, and/or humidity, may be utilized to determine whether the reflecting surface 414 should be checked optically to determine if snow or ice has accumulated thereon. In one specific case, a current temperature below some predetermined temperature threshold, and/or a current humidity above a humidity threshold, in combination with a falling barometric pressure, may cause the control circuitry 502 to perform the optical monitoring of the reflecting surface 414.

In yet other embodiments, the control circuitry 502 may perform the optical monitoring task regardless of the atmospheric condition data being received and processed. According to another embodiment, the optical monitoring is performed first, and the atmospheric data is processed only if the optical monitoring indicates that accumulation of ice or snow may have occurred. If the atmospheric data processing indicates that accumulation is possible, the control circuitry may then activate the heating element 416.

To detect snow or ice accumulation, the control circuitry 502 may activate the optical transmitter 418*a* to generate a transmitted optical signal 420*a*, such as an infrared signal, which impacts the reflecting surface 414, resulting in at least a portion of a returning optical signal 420*b* being detected at the optical receiver 418*b*. The control circuitry 502 processes the returning optical signal 420*b* to determine one or more characteristic values of the signal 420*b*, such as its strength, intensity, or magnitude at one or more frequencies, which may be indicative of whether snow or ice is present on the reflecting surface 414 if such characteristic values lie outside some predetermined range, such as above or below some threshold level. More specifically, the control circuitry 502 may determine that a signal strength of the returning optical signal 420*b* being below some threshold level indicates the presence of ice or snow.

The strength, as well as the frequency spectrum and other characteristics, of the returning optical signal 420*b* is determined at least in part by the characteristics of the transmitted optical signal 420*a*. For example, the transmitted optical signal 420*a* may exhibit a single frequency, a band of frequencies, or multiple discrete frequencies or bands of frequencies. As a result, the control circuitry 502 may process the returning optical signal 420*b* to determine the amplitude, intensity or strength of each frequency or band of frequencies involved, either separately or as a group. The control circuitry 502 may then determine if snow or ice is present on the reflecting surface 414 by comparing each of the determined amplitude or strength values to one or more predetermined values for the amplitude or strength of each frequency or band of frequencies. In one implementation, each of the predetermined values or thresholds is set relative to a specific amplitude of the transmitted optical signal 420*a*. In some embodiments, the control circuitry 502 may alter the strength of the transmitted optical signal 420*a*, thus possibly allowing for multiple predetermined thresholds for each magnitude employed for the transmitted optical signal 420*a*, with each threshold being applicable to a corresponding transmission magnitude.

In some implementations, the control circuitry 502 may establish each threshold taking into account one or more factors that may otherwise cause the control circuitry 502 to misinterpret the characteristics of the returned optical signal 420*b* as indicating the presence of snow or ice. Such factors may include, for example, optical transmitter 418*a* and receiver 418*b* variations, and typical alterations in the reflecting surface 414, such as the fading of paint covering the reflecting surface 414 or dirt accumulation on the reflecting surface 414.

The control circuitry 502 may be configured to selectively activate the optical transmitter 418*a* and receiver 418*b* so that the optical monitoring described above occurs only at specific times, such as when the atmospheric conditions warrant checking for the presence of ice or snow. This selective activation may thus reduce the total amount of power consumed by the operation of the LNB 409.

Once the control circuitry 502, by way of the atmospheric condition data and/or the optical monitoring operations, determines that ice or snow have accumulated on the reflecting surface 414, the control circuitry 502 may activate the heating element 416 to remove the accumulation. To then determine when the heating element 416 is to be deactivated, the control circuitry 502 may simply wait some predetermined period of time after the activation of the heating element 416 before deactivating the heating element 416. In another example, the control circuitry 502 may utilize the optical transmitter 418*a* and receiver 418*b* to determine when the ice or snow has been removed, possibly by way of the same optical strength thresholds described above, or by using a second set of thresholds against which to compare the amplitudes of the returning optical signal 420*b*. In yet other embodiments, the atmospheric condition data may be employed in lieu of, or in combination with, the heating timeout and/or the optical monitoring results.

Once the heating element 416 has been deactivated, the control circuitry 502 may cause the heating element 416 to remain deactivated for some minimum length of time, regardless of the optical monitoring performed or the atmospheric data received. In another embodiment, the heating element 416 may remain deactivated until the monitored temperature drops below some threshold value. By employing a maximum time allowed for the heating element 416 to remain active, a minimum time required for deactivating the heating element 416 before reactivation, a temperature threshold before allowing additional heating, or some combination thereof, the control circuitry 502 may control the power consumption of the heating element 416.

Figure 6:
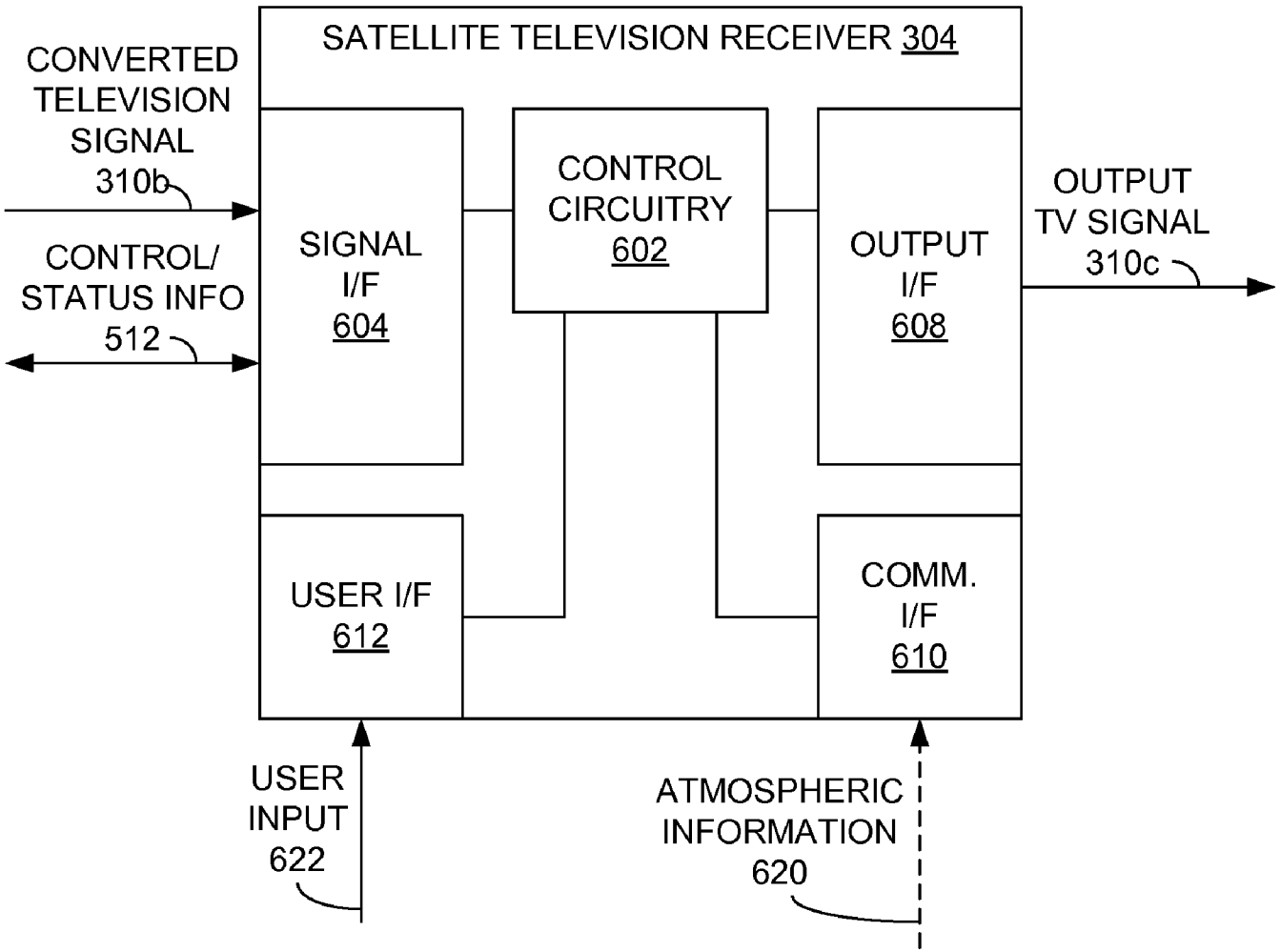
FIG. 6 is a block diagram of a satellite television receiver of the satellite television system shown in FIG. 3 according to an embodiment of the invention.

As mentioned above, a communication device, such as transmitter or receiver, coupled with an outdoor antenna according to the embodiments discussed herein, may interact with the antenna to provide control and processing in lieu of control circuitry for the antenna. Alternatively, the communication device may provide atmospheric condition data for the antenna. One example of such a communication device is the satellite television receiver 304 of FIG. 3, depicted in greater detail in the block diagram of FIG. 6. In this implementation, the satellite television receiver 304 includes control circuitry 602, a signal interface 604, an output interface 608, a communication interface 610, and user interface 612. Other possible components of the receiver 304 may include a power supply, a removable signal processing device ("smart card") interface, and a television signal storage device, but such components are not mentioned further herein to simplify the following discussion.

The signal interface 604 of the receiver 304 is configured to receive the converted television signal 310*b* from the antenna 302, perform any processing necessary to reformat the signal 310*b* for use by the output interface 608, and transfer the signal to the output interface 608. The processing may include, for example, any decryption, decoding, and/or demultiplexing of the signal 310*b*. In one implementation, the signal 310*b* carries multiple television programming channels whose data is formatted according to one of the Motion Picture Experts Group (MPEG) formats, such as MPEG-2 or MPEG-4, although other television content format standards may be utilized in other embodiments. In another example, if the receiver 304 were configured as a terrestrial television receiver, the signal interface 604 may receive the converted television signal 310*b* via a terrestrial antenna receiving television signals "over the air".

The signal interface 604 is also used to send control information 512 to, and receive status information 512 from, the LNB 409 of the satellite antenna 302. Such information 515 may include the returning optical signal 420*b* received at the LNB 409, atmospheric condition data associated with the antenna 302, and any control information 512 from the receiver 304, including control information for the optical transmitter 418*a*, the optical receiver 418*b*, and the heating element 416. In one example, the control and status information 512 adheres to the DiSEqC protocol mentioned above.

The output interface 608 provides the converted television signal 310*b*, after any processing by the signal interface 604, as an output television signal 310*c* to the television 306. To that end, the output interface 608 may encode the television content in accordance with one or more television output formats. For example, the output interface 608 may format the content for one or more of a composite or component video connection with associated audio connection, a modulated radio frequency (RF) connection, a High-Definition Multimedia Interface (HDMI) connection, or any other format compatible with the television 310.

In one arrangement, the receiver 304 may include a separate communication interface 610 configured to receive atmospheric information 620, such as the current temperature, humidity, and barometric pressure of a geographical area of the receiver 304. The communication interface 610 may be any interface configured to communicate via a network, such as the Internet or other wide-area network (WAN), a public switched telephone network (PSTN), a cellular communication network, or the like. Examples of the communication interface 610 may include, but are not limited to, an IEEE 802.11 (i.e., Wi-Fi), Ethernet, Bluetooth®, or HomePlug® interface to a telephone line, or to a cable or Digital Subscriber Line (DSL) gateway for accessing the Internet or another WAN. The atmospheric information 620 may be sourced from some Internet server, a local (e.g., home-specific) weather station, or other atmospheric information device.

To allow a user of the receiver 304 to control the selection of the television content from the converted television signal 310*b*, as well as perform other operations typically associated with a television receiver 304, the user interface 612 may facilitate the entry of commands by way of user input 622. In many examples, the user interface 612 may be a remote control interface configured to receive such input 622 by way of infrared (IR), radio frequency (RF), acoustic, or other wireless signal technologies. To facilitate such information entry, the receiver 304 may provide a menu system presented to the user via the television 306. In some implementations, the user interface 612 may also include any of a keyboard, mouse, and/or other user input device.

The control circuitry 602 is configured to control and/or access other components of the receiver 304, including, but not limited to, the signal interface 604, the output interface 608, the communication interface 610, and the user interface 612. The control circuitry 602 may include one or more processors, such as a microprocessor, microcontroller, or DSP, configured to execute instructions directing the processor to perform the functions associated with the control circuitry 602. In another implementation, the control circuitry 602 may be completely hardware-based logic, or may include a combination of hardware, firmware, and/or software elements.

In operation, the control circuitry 602, via the signal interface 604 and possibly the communication interface 610, may receive atmospheric condition data, such as temperature, humidity, barometric pressure, and the like, and relay that information via the signal interface 604 to the LNB 409 of the antenna 302, which employs that information to determine whether to activate the heating element 416.

In another implementation, the control circuitry 602 may serve to perform the operations described above for the control circuitry 502 of the LNB 409. In other words, the control circuitry 602 may activate the optical transmitter 418*a* and receiver 418*b* to monitor ice or snow accumulation on the reflecting surface 414, receive and process atmospheric condition data, and determine if and when to activate and deactivate the heating element 416, as described in detail above. To that end, the control circuitry 602 employs the control/status information 512 via the signal interface 604 to communicate with the LNB 409 to perform those tasks.

In addition, the control circuitry 602 of the receiver 304 may base any decisions as to whether to activate the heating element 416 on the status of the converted television signal 310*b* being received via the signal interface 604. For example, if the signal strength of the converted television signal 310*b* is above some threshold level, indicating that the reception of the signal 310*b* is not significantly impacted by any accumulation of ice or snow on the reflecting surface 414, the control circuitry 602 may prevent activation of the heating element 416 regardless of the results of the optical monitoring and atmospheric data processing functions. In another example, the receiver 304 may receive the signal strength information from the LNB 409 via the signal interface 604. In yet another implementation, the control circuitry 502 of the LNB 409 may receive and employ the signal strength information in a similar fashion.

User control may also be provided over at least some aspects of the snow/ice detection and antenna heating functions by way of the user input 622 received at the control circuitry 602 via the user interface 612. For example, the control circuitry 602 may present a menu via the television 306 to the user that facilitates user-settable options, such as temperature, humidity, and barometric pressure thresholds to be employed to determine whether ice or snow formation is possible. The user may also be able to set minimum and/or maximum heating times, and may be able to disable the heating functionality. In one example, if the receiver 304 facilitates a "vacation mode" in which the user or the control circuitry 602 may place the receiver 304 in a low-power state for extended periods of time, the control circuitry 602 may disable the heating functionality during such periods. Further, the user may be able to manually activate and deactivate the heating element 416, such as when the snow or ice has accumulated on the reflecting surface 414, but the LNB 409 or the receiver 304 has not automatically detected the accumulation.

At least some embodiments as described herein thus facilitate the automatic detection and removal of ice and snow from a surface of an antenna to promote improved communication signal reception during inclement weather, even if the antenna is out of reach, or out of sight, of the user. Further, by activating a means to heat the antenna to remove snow or ice only when such removal appears to be necessary, a significant amount of power may be conserved. In addition, by employing both an optical monitoring means to detect ice and snow accumulation and an analysis of atmospheric conditions to determine if such accumulation is possible, the possibility of unnecessarily heating the antenna is further reduced. User control of the detection and/or removal process is also possible in some configurations.

While several embodiments of the invention have been discussed herein, other implementations encompassed by the scope of the invention are possible. For example, while various embodiments have been described largely within the context of satellite television antennas and associated receivers or set-top boxes, other communication devices that either transmit or receive communications via an outdoor antenna, such as terrestrial television antennas or set-top boxes and amateur radio systems, may incorporate various aspects of the functionality described above to similar effect. In addition, aspects of one embodiment disclosed herein may be combined with those of alternative embodiments to create further implementations of the present invention. Therefore, while the present invention has been described in the context of specific embodiments, such descriptions are provided for illustration and not limitation. Accordingly, the proper scope of the present invention is delimited only by the following claims and their equivalents.

What is claimed is:

1. A method of detecting and removing snow and/or ice on a communication antenna, the method comprising:

receiving environmental data indicative of at least one current environmental condition affecting the communication antenna;

transmitting an optical signal from a signaling structure of the communication antenna toward a reflecting surface of the communication antenna;

receiving the optical signal at the signaling structure upon returning from the reflecting surface;

processing the returning optical signal to determine at least one characteristic value of the returning optical signal; and heating the reflecting surface if the environmental data indicates that ice or snow accumulation on the communication antenna is possible, and the at least one characteristic value of the returning optical signal is outside a first range.

2. The method of claim 1, wherein:

the environmental data is generated by an electronic device not dependent upon the communication antenna for communication.

3. The method of claim 1, further comprising:

ceasing the heating of the reflecting surface when the at least one characteristic value of the returning optical signal is within a second range or the reflecting surface has been heated for at least a first length of time.

4. The method of claim 3, further comprising:

waiting at least a second length of time after ceasing the heating of the reflecting surface until heating the reflecting surface again based on the environmental data and the at least one characteristic value of the returning optical signal.

5. The method of claim 1, further comprising:

heating the signaling structure while heating the reflecting surface.

6. The method of claim 1, wherein:

the at least one current environmental condition comprises a current temperature of a geographical area including the communication antenna; and heating the reflecting surface occurs if the at least one characteristic value of the returning optical signal is outside the first range, and the environmental data indicative of the current temperature is below a first level.

7. The method of claim 6, wherein:

the at least one current environmental condition comprises a current humidity of air of the geographical area including the communication antenna; and heating the reflecting surface occurs if the at least one characteristic value of the returning optical signal is outside the first range, the environmental data indicative of the current temperature is below the first level, and the environmental data indicative of the current humidity is above a second level.

8. The method of claim 6, wherein:

the at least one current environmental condition comprises a trend in a barometric air pressure of the geographical area including the communication antenna; and heating the reflecting surface occurs if the at least one characteristic value of the returning optical signal is outside the first range, the environmental data indicative of the current temperature is below the first level, and the environmental data indicative of the trend in the barometric air pressure is negative.

9. The method of claim 1, wherein:

the transmitted optical signal comprises an infrared optical signal.

10. The method of claim 1, wherein:

the at least one characteristic of the returning optical signal comprises a strength of the returning optical signal at one or more frequencies;

the transmitted optical signal comprises at least one frequency at which the strength of the returning optical signal is attenuated in the presence of ice or snow covering the reflecting surface; and processing the returning optical signal to determine the at least one characteristic of the returning optical signal comprises determining a strength of the returning optical signal at each of the one or more frequencies.

11. A communication antenna, comprising:

a signaling structure comprising:

circuitry configured to perform at least one of:

receive a communication signal wirelessly and transfer the communication signal to an electronic device coupled with the antenna; and receive the communication signal from the electronic device and transmit the communication signal wirelessly;

a reflecting structure coupled with the signaling structure, wherein the reflecting structure comprises a reflecting surface configured to redirect the communication signal received from or transmitted to the signaling structure circuitry;

a heating element configured to heat the reflecting surface; and an optical signal transmitter and an optical signal receiver attached to the signaling structure, wherein the optical signal transmitter is configured to transmit an optical signal toward the reflecting surface so that it may be received at the optical signal receiver;

wherein the signaling structure further comprises control circuitry configured to:

receive environmental data indicative of at least one current environmental condition;

process the optical signal received at the optical signal receiver to determine at least one characteristic of the received optical signal; and cause the heating element to heat the reflecting surface if the environmental data indicates that ice or snow accumulation on the reflecting structure is possible, and the at least one characteristic of the received optical signal is outside a first range.

12. The communication antenna of claim 11, wherein:

the current environmental condition comprises a current temperature of a geographical area associated with the communication antenna.

13. The communication antenna of claim 11, wherein:

the environmental data is originated by a second electronic device not transmitting the communication signal to, or receiving the communication signal from, the signaling structure circuitry.

14. The communication antenna of claim 13, wherein:

the control circuitry is configured to receive the environmental data indicative of the current temperature from the second electronic device via the first electronic device and the signaling structure circuitry.

15. The communication antenna of claim 13, further comprising:

a communication interface configured to receive the environmental data indicative of the current temperature from the second electronic device and transfer the environmental data indicative of the current temperature to the control circuitry.

16. The communication antenna of claim 11, wherein:

the optical signal comprises at least one frequency;

the at least one characteristic of the received optical signal is the amplitude of at least one frequency of the received optical signal; and the amplitude of the received optical signal is less at one or more frequencies when the reflecting surface is covered with snow or ice than when the reflecting surface is not covered with snow or ice.

17. The communication antenna of claim 11, wherein:

the heating element is located adjacent the reflecting surface opposite the signaling structure.

18. The communication antenna of claim 11, wherein:

the heating element is configured to heat at least a portion of the signaling structure;

wherein the control circuitry is configured to cause the heating element to heat the signaling structure at the same time the heating element heats the reflecting surface.

19. A communication receiver, comprising:

a signal interface configured to receive a communication signal from a communication antenna; and control circuitry configured to:

receive a current temperature associated with the communication antenna;

receive an indication as to whether a reflecting surface of the communication antenna is obscured with ice or snow; and transmit a control signal via the signal interface to the communication antenna to cause the communication antenna to heat the reflecting surface if the current temperature is below a predetermined value and the indication indicates that the reflecting surface is obscured with ice or snow.

20. The communication receiver of claim 19, further comprising:

a communication interface configured to receive the indication of the current temperature from a weather information monitoring device.

21. The communication receiver of claim 19, further comprising:

a user interface configured to receive user input to transmit the control signal via the signal interface to the communication antenna to cause the communication antenna to heat the reflecting surface regardless of the indication of the current temperature and the indication as to whether the reflecting surface is obscured with ice or snow.

22. The communication receiver of claim 19, wherein:

the control circuitry is further configured to receive an indication of a strength of the communication signal, and to prevent the heating of the reflecting surface if the indication of the strength of the communication signal is above a first level.

* * * * *